US007590029B2

(12) United States Patent
Tingley

(10) Patent No.: US 7,590,029 B2
(45) Date of Patent: Sep. 15, 2009

(54) METHODS AND SYSTEMS FOR COMMUNICATING DATA THROUGH A PIPE

(75) Inventor: Robert D. Tingley, Ashland, MA (US)

(73) Assignee: The Charles Stark Draper Laboratory, Inc., Cambridge, MA (US)

( * ) Notice: Subject to any disclaimer, the term of this patent is extended or adjusted under 35 U.S.C. 154(b) by 506 days.

(21) Appl. No.: 11/362,629

(22) Filed: Feb. 24, 2006

(65) Prior Publication Data

US 2006/0187755 A1 Aug. 24, 2006

Related U.S. Application Data

(60) Provisional application No. 60/656,030, filed on Feb. 24, 2005.

(51) Int. Cl.
*G01V 1/40* (2006.01)

(52) U.S. Cl. ..... 367/82; 367/76; 175/40; 166/73

(58) Field of Classification Search ..... 367/76, 367/82; 175/40; 166/73
See application file for complete search history.

(56) References Cited

U.S. PATENT DOCUMENTS 3,205,477 A 9/1965 Kalbfell
3,252,225 A 5/1966 Hixson
3,475,722 A 10/1969 White
3,520,375 A 7/1970 Raynal et al.
3,588,804 A 6/1971 Fort
3,789,935 A * 2/1974 Saadeh ..... 175/40
3,790,930 A 2/1974 Lamel et al.
4,001,773 A 1/1977 Lamel et al.
4,282,588 A 8/1981 Chanson et al.
4,293,937 A 10/1981 Sharp et al.
4,298,970 A 11/1981 Shawhan et al.
4,314,365 A 2/1982 Petersen et al.
4,518,888 A * 5/1985 Zabcik ..... 310/334
4,562,559 A 12/1985 Sharp et al.
4,590,593 A 5/1986 Rodney
5,128,901 A 7/1992 Drumheller
5,222,049 A 6/1993 Drumheller
5,274,606 A 12/1993 Drumheller et al.
5,303,203 A * 4/1994 Kingman ..... 367/75
5,477,505 A 12/1995 Drumheller
5,703,836 A 12/1997 Drumheller
6,147,932 A 11/2000 Drumheller
6,188,647 B1 2/2001 Drumheller
6,320,820 B1 11/2001 Gardner et al.

(Continued)

OTHER PUBLICATIONS

D.S. Drumheller, "Acoustical Properties of Drill Strings," *Journal of the Acoustical Society of America*, 85 (3) Mar. 1989, pp. 1048-1064.

(Continued)

*Primary Examiner*—Timothy Edwards, Jr.
(74) *Attorney, Agent, or Firm*—Goodwin Procter LLP

(57) ABSTRACT

An acoustic telemetry system includes a piezoelectric stack at least partially disposed within a segment of pipe, and electrical circuitry for controlling the piezoelectric stack. In response to a signal from the electrical circuitry, the piezoelectric stack generates a plurality of acoustic signals for transmission through the pipe at different frequencies spanning multiple regions of a frequency response for the pipe.

21 Claims, 6 Drawing Sheets

U.S. PATENT DOCUMENTS

| | | | | |
|---|---|---|---|---|
| 6,370,082 | B1 | 4/2002 | Gardner et al. | |
| 6,434,084 | B1 | 8/2002 | Schultz | |
| 6,470,996 | B1 | 10/2002 | Kyle et al. | |
| 6,847,585 | B2 * | 1/2005 | Macpherson | 367/82 |

OTHER PUBLICATIONS

D.S. Drumheller, "Attenuation of Sound Waves in Drill Strings," *Journal of the Acoustical Society of America*, 94 (4) Oct. 1993, pp. 2387-2396.

D.S. Drumheller, "Extensional Stress Waves in One-Dimensional Elastic Waveguides," *Journal of the Acoustical Society of America*, 92 (6) Dec. 1992, pp. 3389-3402.

D.S. Drumheller and S.D. Knudsen, "The Propagation of Sound Waves in Drill Strings," *Journal of the Acoustical Society of America*, 97 (4) Apr. 1995, pp. 2116-2125.

F. Schloss, "Accelerometer Noise," *Sound and Vibration*, vol. 27, No. 3, Mar. 1993, pp. 22-23.

G. Myers et al, "Drill String Vibration: A Proxy for Identifying Lithologic Boundaries While Drilling," *Proceedings of the Ocean Drilling Program, Scientific Resulsts* vol. 179, May 2002, pp. 1-17.

"Technical Information, Product Specifications of Piezoelectric Ceramics," Morgan ElectroCeramics, May 16, 2001, pp. 1-14.

T.G. Barnes and B.R. Kirkwood, "Passbands for Acoustic Transmission in an Idealized Drill String," *Journal of the Acoustical Society of America*, 51 (5) 1972, pp. 1606-1608.

V.N.R. Rao and J.K. Vandiver, "Acoustics of Fuid-Filled Boreholes with Pipe: Guided Propagation and Radiation," *Journal of the Acoustical Society of America*, 105 (6) Jun. 1999, pp. 3057-3066.

W.D. Squire and H.J. Whitehouse, "A New Approach to Drill String Acoustic Telemetry," *Proceedings of the Society of Petroleum Engineers*, SPE 8340 1979, pp. 1-8.

* cited by examiner

METHODS AND SYSTEMS FOR COMMUNICATING DATA THROUGH A PIPE

CROSS-REFERENCE TO RELATED APPLICATION

This application claims priority to and the benefit of, and incorporates herein by reference in its entirety, U.S. Provisional Patent Application Serial No. 60/656,030, which was filed on Feb. 24, 2005.

TECHNICAL FIELD

The present invention generally relates to data communication. More particularly, the invention relates to methods and systems for acoustically communicating data through a pipe.

BACKGROUND

Wells of the type commonly used for petroleum or geothermal exploration are often on the order of 1.5 miles deep. Typically, these wells or "boreholes" are drilled using pipes (also referred to as "drill strings") assembled from relatively light metal sections connected end-to-end by tooling joints. These sections are generally about 30 to 45 feet long. To form a borehole, the drill string is rotated such that a drill bit attached to its "downhole" or operative end bites into the earth. Additional sections are typically added to the "uphole" or surface end of the drill string as the borehole deepens.

In addition, a fluid, often referred to as "drilling mud" can be pumped through an axial hole in the drill string from the surface to the downhole end of the drill string. The drilling mud exits the drill string at the downhole end and returns to the surface through the space between the drill string and the borehole. The drilling mud serves several purposes, including, for example, cooling and lubricating the drill bit, powering the drill bit through hydrodynamic pressure, providing a deposit on the borehole wall to seal the formation, and removing loose cuttings and debris from the borehole.

When exploring and/or recovering natural resources by drilling in this manner, real-time communication between the downhole unit disposed proximate to the end of the borehole and the surface unit disposed near the opening of the borehole is desirable. For example, it enables an operator of the drill string to monitor one or more sensors located proximate to the operative end of the drill string, and to steer the drill bit depending on data received from the sensors. Communication from the downhole unit to the surface unit of data relating to, for example, the temperature and/or pressure of the drilling mud proximate to the drill bit may also be desirable. In addition, it may be desirable to transmit management information from the downhole unit to the surface unit or, alternatively, in the opposite direction. Exemplary management information includes additional information relating to the sensed data, such as, for example, how much and what type of data has been sensed, when the transmission of the sensed data to begin, and, if different types of data have been sensed, the order in which they are to be transmitted.

One conventional data communication or "telemetry" technique is often referred to as a "mud pulse," whereby the borehole is filled with the artificial drilling mud, whose density, viscosity, and other properties are adjustable according to the condition of the formation drilled. A valve located at the drill bit is cycled in accordance with a data sequence so that each actuation of the valve releases a pressure pulse from the drill string into the fluid-filled borehole. This technique, however, has several drawbacks. For instance, data communication is only unidirectional, i.e., from the downhole unit to the surface unit, and the data rate is less than 1 bit/second. In addition, the mud pulse technique requires a pressurized drill string, which limits the drill string's applicability. Poor drilling performance may also result.

Other techniques for communicating between the downhole unit and the surface unit have also been employed, including electromagnetic radiation through the ground formation and electrical transmission through an insulated conductor. Both of these methods have, however, disadvantages associated with signal attenuation, ambient noise, high temperatures, and compatibility with standard drilling procedures. For example, known electromagnetic telemetry systems deliver data at a rate of about only 1 bit/second out to 6000 feet.

Some researchers have also pursued drill string telemetry by acoustic wave propagation through a metal drill string. One technique, for example, relies on narrowband frequency shift key modulation. Disadvantages of this approach, however, include a data rate that is limited to 8 bits/second and a communication range that is effectively limited to 6000 feet. In addition, these acoustic telemetry systems do not operate while drilling is in progress. When they do operate, communication is only unidirectional. Another disadvantage is that characterization and sorting of tubing is often required.

Another similar approach utilizes narrowband amplitude key modulation. Disadvantages of this approach also include a data rate that is limited to 8 bits/second and a communication range that is effectively limited to 6000 feet. A telemetry system based on narrowband amplitude key modulation also does not operate while drilling is in progress, and, when it does operate, communication is only unidirectional. Another disadvantage is that calibration is required prior to each transmission.

There is, therefore, a need for a versatile acoustic telemetry system that addresses the shortcomings of prior approaches.

SUMMARY OF THE INVENTION

The present invention greatly improves the rate and range of data transmission, as well as the reliability of an acoustic telemetry system, by employing broadband, as opposed to narrowband, acoustic wave propagation through a drill string or pipe. By transmitting multiple sets of data simultaneously at different frequencies, the effective rate of the data transmission and the range of the acoustic telemetry system are increased. For example, certain embodiments of the acoustic telemetry system of the present invention are capable of providing a data rate of better than 1000 bits/second at 6000 feet, and better than 10 bits/second out to 20,000 feet.

While particularly described in conjunction with a drill string in a drilling system, the present invention is not so limited and can be employed to communicate data through any buried or elevated distributed pipe system, such as, for example, the Trans-Alaska Pipeline System. When specifically employed to communicate data through a drill string in a drilling system, however, the acoustic telemetry system of the present invention eliminates the need to measure and sort tubing in advance, requires no time-consuming calibration prior to each use, and is capable of transmitting data during drilling.

Generally, in one aspect, the invention features a method for communicating data through a drill string in a drilling system. The drilling system typically includes a downhole unit and a surface unit, and extends from the downhole unit to the surface unit. An electrical signal that includes data indicative of at least one system parameter is received, and a plurality of acoustic signals that are based on the electrical signal are derived. Each of the plurality of acoustic signals represents at least a portion of the data, and the plurality of acoustic signals are transmitted through the drill string at different frequencies spanning multiple regions of a frequency response for the drill string. In one embodiment of this aspect of the invention, the plurality of acoustic signals may be transmitted from the downhole unit towards the surface unit.

Generally, in another aspect, the invention features a method for communicating data through a pipe. An electrical signal that includes data indicative of at least one parameter is received, and a plurality of acoustic signals that are based on the electrical signal are derived. Each one of the plurality of acoustic signals represents at least a portion of the data, and the plurality of acoustic signals are transmitted through the pipe at different frequencies spanning multiple regions of a frequency response for the pipe.

Various embodiments of the two foregoing aspects of the invention include the following features. At least a portion of the plurality of acoustic signals may be received and the data decoded therefrom. In decoding the data, a subset of the received acoustic signals, with each acoustic signal in the subset having an amplitude greater than a pre-determined value, may be selected for analysis. Moreover, a discrepancy in the decoded data may be identified and the discrepancy resolved with at least one of a majority rule decoding technique and a maximal ratio combining decoding technique.

In other embodiments of the two foregoing aspects of the invention, at least one parameter of the plurality of transmitted acoustic signals is measured at a segment of the drill string or pipe proximate to an origin for the transmission. The measured parameter may be compared with an anticipated value therefor and at least one of the plurality of acoustic signals may be adjusted. In yet another embodiment, a noise signal in the drill string or pipe is sensed at at least one noise frequency. In such an embodiment, each acoustic signal of the plurality of acoustic signals is transmitted through the drill string (or pipe) at a frequency different from the at least one noise frequency.

In general, in yet another aspect, the invention features a method for noise cancellation during data communication through a pipe. According to the method, an electrical signal is received and an acoustic signal based on the electrical signal is derived. A noise signal in the pipe is also sensed and a corrective signal is generated to counteract the noise signal. Both the acoustic signal and the corrective signal are transmitted through the pipe.

In one embodiment of this aspect of the invention, the acoustic signal and the corrective signal are each imparted to the pipe through a common transducer. Alternatively, the acoustic signal and the corrective signal may each be imparted to the pipe through different transducers.

Generally, in still another aspect, the invention features an acoustic telemetry system. The system includes a pipe, a piezoelectric stack at least partially disposed within a segment of the pipe, and first electrical circuitry for controlling the piezoelectric stack. The piezoelectric stack is for generating a plurality of acoustic signals for transmission through the pipe at different frequencies spanning multiple regions of a frequency response for the pipe.

In general, in a further aspect, the invention features an acoustic telemetry system. The system includes a piezoelectric stack for disposition within a segment of a pipe and first electrical circuitry for controlling the piezoelectric stack. The stack, when disposed within the segment of the pipe, generates a plurality of acoustic signals for transmission through the pipe at different frequencies spanning multiple regions of a frequency response for the pipe.

Various embodiments of the two immediately preceding aspects of the invention include the following features. The piezoelectric stack may include a plurality of piezoelectric elements each having a different thickness or, alternatively, a plurality of piezoelectric elements each having a substantially uniform thickness. In addition, the acoustic telemetry system may further include a sensor, in electrical communication with the first electrical circuitry, for (i) detecting at least one system parameter and (ii) generating an electrical signal in response thereto. The electrical signal may include data indicative of the at least one system parameter and each one of the plurality of acoustic signals may represent at least a portion of the data.

In one embodiment, the sensor measures either or both the pressure and the temperature of a fluid within the pipe. In another embodiment, the acoustic telemetry system further includes a drill bit located at an operative end of the pipe and the sensor measures a resistance encountered by the drill bit. Alternatively, the sensor processes image data proximate to the drill bit.

In yet another embodiment, the drill bit located at the operative end of the pipe is also proximate to the piezoelectric stack, and a downhole accelerometer for measuring at least one of (i) the plurality of acoustic signals generated for transmission through the pipe and (ii) a noise signal in the pipe may be disposed proximate to the drill bit and the piezoelectric stack. In one such embodiment, the noise signal is present in the pipe at at least one noise frequency and the first electrical circuitry controls the piezoelectric stack to generate the plurality of acoustic signals for transmission through the pipe at frequencies different from the at least one noise frequency. Alternatively, in one such embodiment, the first electrical circuitry controls the piezoelectric stack to generate a corrective signal that counteracts the noise signal.

In still another embodiment, the acoustic telemetry system includes a downhole unit disposed proximate to an operative end of the pipe and a surface unit. In one such embodiment, the pipe extends from the downhole unit to the surface unit. The surface unit may include a surface accelerometer for measuring at least a portion of the plurality of acoustic signals and second electrical circuitry for decoding data from the acoustic signals measured at the surface unit. In addition, a subset of the acoustic signals measured at the surface unit, with each acoustic signal in the subset having an amplitude greater than a pre-determined value, may be selected by the second electrical circuitry as it decodes the data. Also, the second electrical circuitry may identify a discrepancy in the decoded data and resolve the discrepancy with at least one of a majority rule decoding technique and a maximal ratio combining technique.

These and other objects, along with advantages and features of the present invention herein disclosed, will become more apparent through reference to the following description, the accompanying drawings, and the claims. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

In the following description, various embodiments of the present invention are described with reference to the following drawings, in which.

DETAILED DESCRIPTION

In broad overview, the present invention counteracts the effects of time-spreading and reduces the likelihood that data is lost or corrupted because an acoustic signal is transmitted through a drill string at a frequency corresponding to a null in the frequency domain. For example, in various embodiments, the present invention employs broadband, as opposed to narrowband, communication techniques, desirably with redundancy, to acoustically transmit data through a drill string or pipe. More specifically, in some embodiments of the invention, a plurality of acoustic signals, some of which contain the same (i.e., redundant) information, or portions of information, as other acoustic signals, are transmitted through the drill string or pipe substantially simultaneously at different frequencies spanning multiple regions of a frequency response for the drill string or pipe. In such a fashion, the likelihood of receiving complete, and correct, data at the opposite end of the drill string or pipe is greatly improved.

In addition to improving the reliability and data integrity of an acoustic telemetry system, the broadband communication techniques of the present invention also greatly improve the rate and range of data transmission in the acoustic telemetry system. Moreover, when the acoustic telemetry system of the present invention is employed to communicate data through a drill string in a drilling system, the need to measure and sort tubing in advance is eliminated, as is the need to calibrate the system prior to each use, which can often be time-consuming.

In some embodiments, the acoustic telemetry system of the present invention also provides methods and apparatus for canceling noise during data communication through the drill string or pipe. As described below, antinoise signals or, alternatively, orthogonal signals may be provided to eliminate the deleterious effects of noise.

Figure 1:
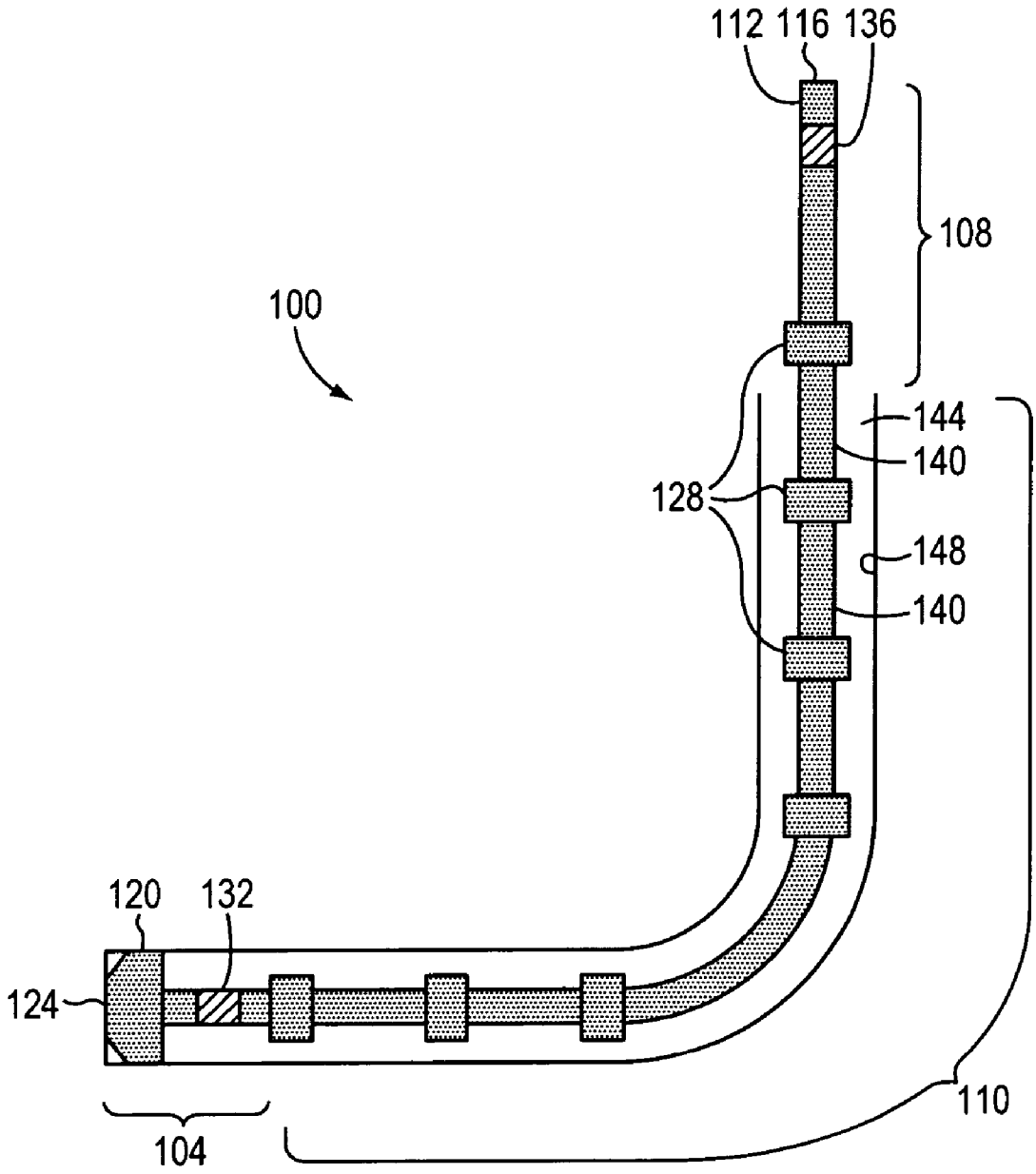
FIG. 1 depicts a schematic side view of an exemplary drilling system, including an exemplary drill string, that may be used for exploring and recovering natural resources.

Referring to FIG. 1, in one embodiment, a drilling system 100 for exploring and recovering natural resources generally includes a downhole unit 104, a surface unit 108, and a middle portion 110 extending therebetween. Included within the drilling system 100 is a pipe or drill string 112 that includes a proximal end 116 at the surface of the formation drilled (i.e., proximate to the surface unit 108) and a distal, or operative, end 120 proximate to the downhole unit 104. In one embodiment, the drill string 112 includes a drill bit 124 at its operative end 120, several tooling joints 128 along its length, a first acoustic transceiver 132 near its operative end 120, and a second acoustic transceiver 136 at its proximal end 116. The tooling joints 128 serve to connect discrete sections 140 of the drill string. In operation, the drill string is used to drill a borehole 144. As the borehole deepens, additional sections 140 of drill pipe may be added to the drill string at its proximal end.

Typically, drilling mud or fluid is pumped through an axial hole (not shown) in the drill string 112 from its proximal end 116 to its operative end 120. The drilling mud, whose density, viscosity, and other properties are adjustable according to the condition of the formation drilled, exits the drill string near its operative end and returns to the surface in the space provided between the drill string and a wall 148 of the borehole 144. The drilling mud may serve several purposes, such as, for example, cooling and lubricating the drill bit 124, powering the drill bit through hydrodynamic pressure, providing a sealing deposit on the wall of the borehole, and removing loose cuttings and debris from the borehole.

Figure 2:
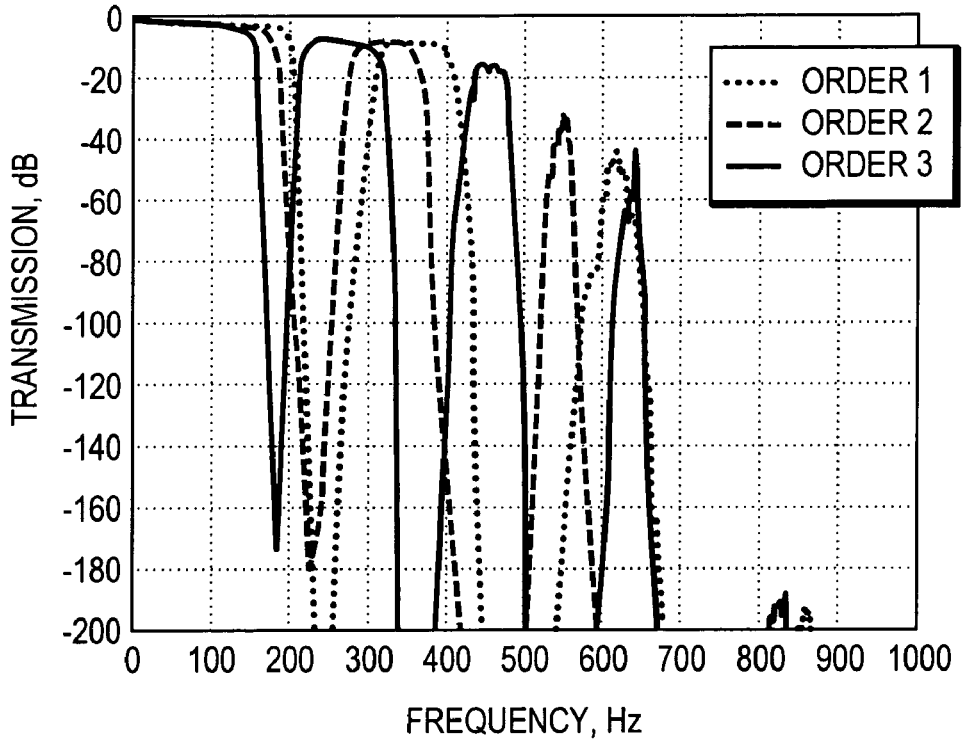
FIG. 2 depicts exemplary frequency response plots of the acoustic propagation channels through the drill string of FIG. 1 for three different versions of the drill string.

FIG. 2 depicts exemplary frequency response plots of the acoustic propagation channels through the drill string 112 for three different versions of the drill string. As a result of reflections occurring at the tooling joints 128, the frequency response plots have a roughly periodic appearance. As shown, the frequency response plots alternate between regions of low-loss transmission and regions of virtually no transmission.

Due to the wear and manufacturing tolerances of the component sections 140 of the drill string 112, each drill string will have a unique frequency response depending on the order in which its component sections are assembled, as depicted in the frequency response plots of FIG. 2, which represent three different frequency responses for three different orderings of the sections within the drill string. In addition, the frequency response will change significantly as the borehole 144 deepens and additional sections are added to the drill string. Accordingly, the frequency response of the drill string is both highly variable and not known prior to its assembly.

Figure 3:
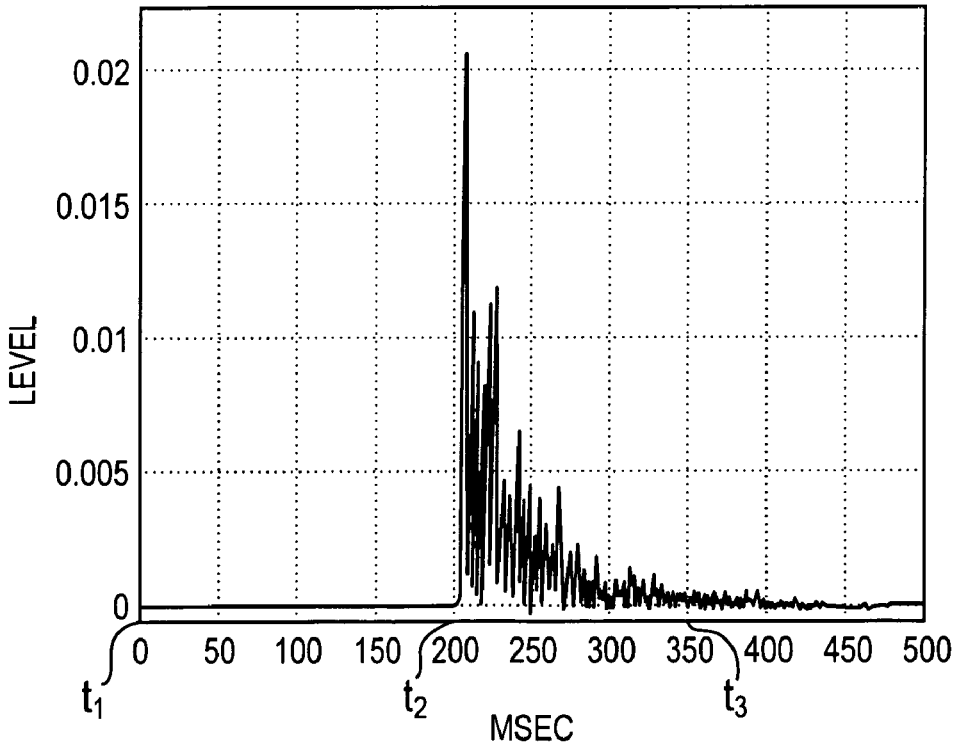
FIG. 3 depicts an exemplary impulse response plot for the acoustic propagation channel of the drill string of FIG. 1.

FIG. 3 depicts an exemplary impulse response plot for an acoustic propagation channel of the drill string 112 shown in FIG. 1. As shown in FIG. 3, when an acoustic pulse is transmitted through the drill string, reflections at the tooling joints 128 cause time spreading of the acoustic signal. For example, in one embodiment, a pulse may be acoustically transmitted from the first transceiver 132 of the drill string at time $t_1=0$ and first received through the drill string 112 at the second transceiver 136 just after $t_2=200$ msec. However, due to reflections (or echoes) occurring at the tooling joints, a series of delayed pulses, having different phases, may also be received between the time just after the first pulse is received and approximately $t_3=350$ msec. These pulses may interfere destructively with one another and cancel each other out, resulting in a null in the frequency response plots of FIG. 2.

Thus, in its various embodiments explained in detail below, the present invention employs broadband, as opposed to narrowband, communication techniques, with redundancy, to acoustically transmit data through the drill string 112. By transmitting redundant broadband signals through the drill string, the likelihood of receiving complete, and correct, data at the opposite end of the drill string is greatly improved. More specifically, the effects of time-spreading are counteracted and the likelihood that data is corrupted or lost entirely is reduced because, even if one acoustic signal is transmitted through the drill string at a frequency corresponding to a null in the frequency domain, it is likely that another signal carrying information redundant to that contained in the lost signal is not also transmitted at a null.

Figure 4:
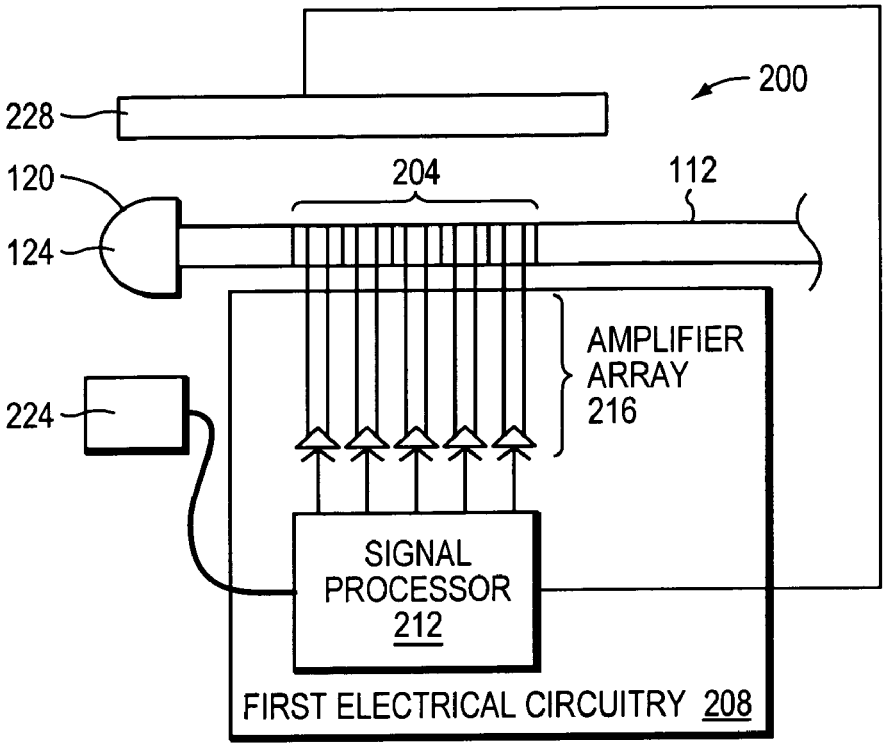
FIG. 4 depicts a downhole portion of the drilling system of FIG. 1 in accordance with an illustrative embodiment of the invention.
Figure 5:
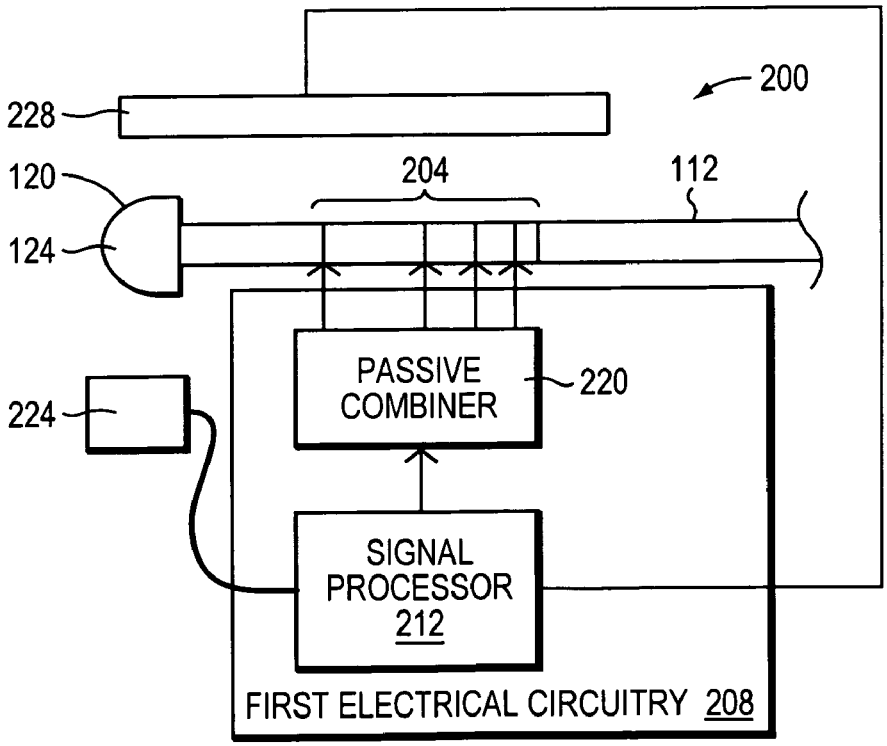
FIG. 5 depicts a downhole portion of the drilling system of FIG. 1 in accordance with another illustrative embodiment of the invention.

FIGS. 4 and 5 each depict a downhole portion of the drilling system of FIG. 1 in accordance with various illustrative embodiments for the acoustic telemetry system of the present invention. As shown in FIGS. 4 and 5, an acoustic telemetry system 200 includes the drill string or pipe 112 together with the drill bit 124 located at its operative end 120, a piezoelectric stack 204 at least partially disposed within a segment of the drill string or pipe 112, and electrical circuitry 208 for controlling the piezoelectric stack 204.

Referring to FIG. 4, in one particular embodiment of the invention, the piezoelectric stack 204 is uniform, i.e., it includes a plurality of piezoelectric elements, each having a substantially uniform thickness. In this embodiment, the electrical circuitry 208 may include a signal processor 212 and an amplifier array 216. Alternatively, referring to FIG. 5, in another embodiment of the invention, the piezoelectric stack 204 is stagger-tuned and includes a plurality of piezoelectric elements, each having a different thickness. In this embodiment, the electrical circuitry 208 may include the signal processor 212 and a passive combiner 220. In either embodiment, however, the piezoelectric stack may be located proximate to the drill bit 124 and, as further explained in detail below, may be configured to generate, based on electrical signals received from the electrical circuitry 208, a plurality of acoustic signals for broadband transmission through the drill string. In other words, the piezoelectric stack may be configured to generate a plurality of acoustic signals for transmission through the drill string at different frequencies spanning multiple regions of its frequency response.

In some embodiments, the acoustic telemetry system 200 further includes a sensor 224 in electrical communication with the electrical circuitry 208. The sensor may be used to detect a system parameter. For example, the sensor may measure the pressure of the artificial fluid or mud within the drill string, the temperature of the fluid or mud, and/or the resistance encountered by the drill bit 124 in drilling the borehole 144. Often, the measured amount of resistance encountered by the drill bit indicates the condition of the formation drilled. For example, the measured resistance may indicate the proximity of a natural gas pocket. Additionally, the sensor may process image data proximate to the drill bit, often useful for steering the drill bit.

In various embodiments, after having detected, measured, and/or processed the one or more system parameters, the sensor 224 generates an electrical signal in response thereto. Typically, the electrical signal generated by the sensor includes data indicative of the one or more system parameters. As described below, the electrical signal generated by the sensor may then be processed by the electrical circuitry 208 and converted into a plurality of acoustic signals by the piezoelectric stack 204 for transmission through the drill string or pipe 112.

In some embodiments, a downhole accelerometer 228 is disposed proximate to the drill bit 124 and the piezoelectric stack 204. In certain versions of these embodiments, the downhole accelerometer is used to measure the plurality of acoustic signals generated for transmission through the drill string by the piezoelectric stack 204 and/or a noise signal present in the drill string 112. For example, the drill bit, in drilling the surrounding formation, may impart a noise signal to the drill string or pipe. Placing the downhole accelerometer proximate to the drill bit allows for the noise imparted by the drill bit to be measured at its source.

For ease of illustration and explanation, the piezoelectric stack 204, the electrical circuitry 208, the sensor 224, and the accelerometer 228 are depicted in FIGS. 4 and 5 to be located at the operative end 120 of the drill string or pipe 112 (i.e., within the downhole unit 104 of the drilling system 100). In such an arrangement, the plurality of acoustic signals generated by the piezoelectric stack 204 are transmitted from the downhole unit 104 of the drilling system 100 towards its surface unit 108. One skilled in the art will readily understand, however, that the piezoelectric stack, the electrical circuitry, the sensor, and/or the accelerometer may be located at the proximal end of the drill string (i.e., at the surface unit of the drilling system), and the plurality of acoustic signals transmitted from the surface unit towards the downhole unit. More generally still, the piezoelectric stack, the electrical circuitry, the sensor, and/or the accelerometer may be located at any point along the drill string or pipe (or at any point along a distributed pipeline), and the acoustic signals transmitted through the drill string or pipe in any direction. Moreover, data other than the data detected, measured, and/or processed by the sensor 224 may be transmitted through the drill string or pipe 112. For example, management data, as mentioned above, may be transmitted through the drill string or pipe, either in addition to, or as an alternative to, the data detected, measured, or processed by the sensor.

Figure 6:
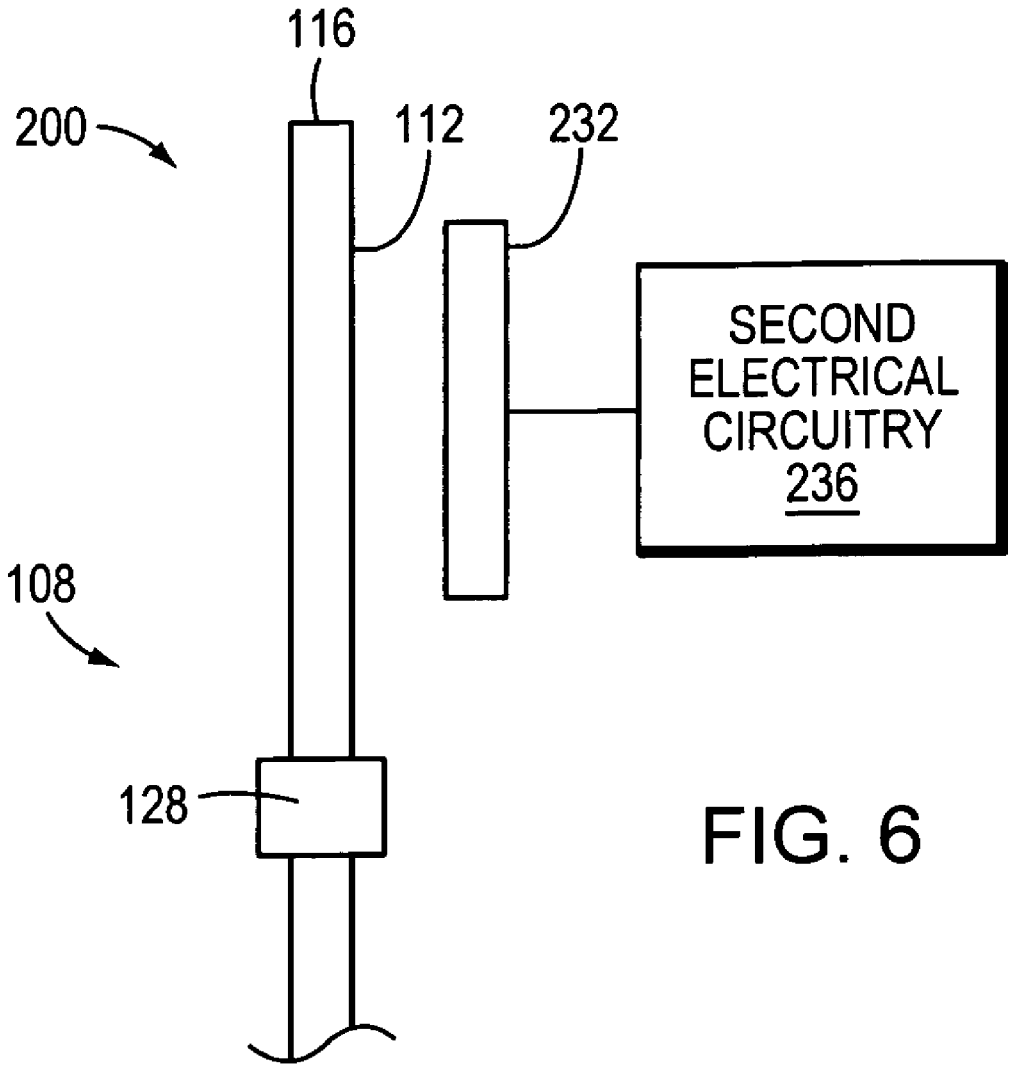
FIG. 6 depicts a surface portion of the drilling system of FIG. 1 in accordance with an illustrative embodiment of the invention.

Referring to FIG. 6, the surface unit 108 of the drilling system of FIG. 1, in accordance with one illustrative embodiment of the acoustic telemetry system 200 of the present invention, includes a surface accelerometer 232 for measuring at least a portion of the plurality of acoustic signals transmitted through the drill string or pipe 112 by the piezoelectric stack 204, and electrical circuitry 236 for decoding, as described in more detail below, the data from the acoustic signals measured at the surface unit 108 by the accelerometer 232. Again, one skilled in the art will readily understand that the accelerometer and the electrical circuitry may be placed at any point along the drill string, such as within the downhole unit, or at any point along a distributed pipeline located above or below ground where it is desirable to receive the acoustic signals transmitted by the piezoelectric stack and decode the data therefrom.

Figure 7:
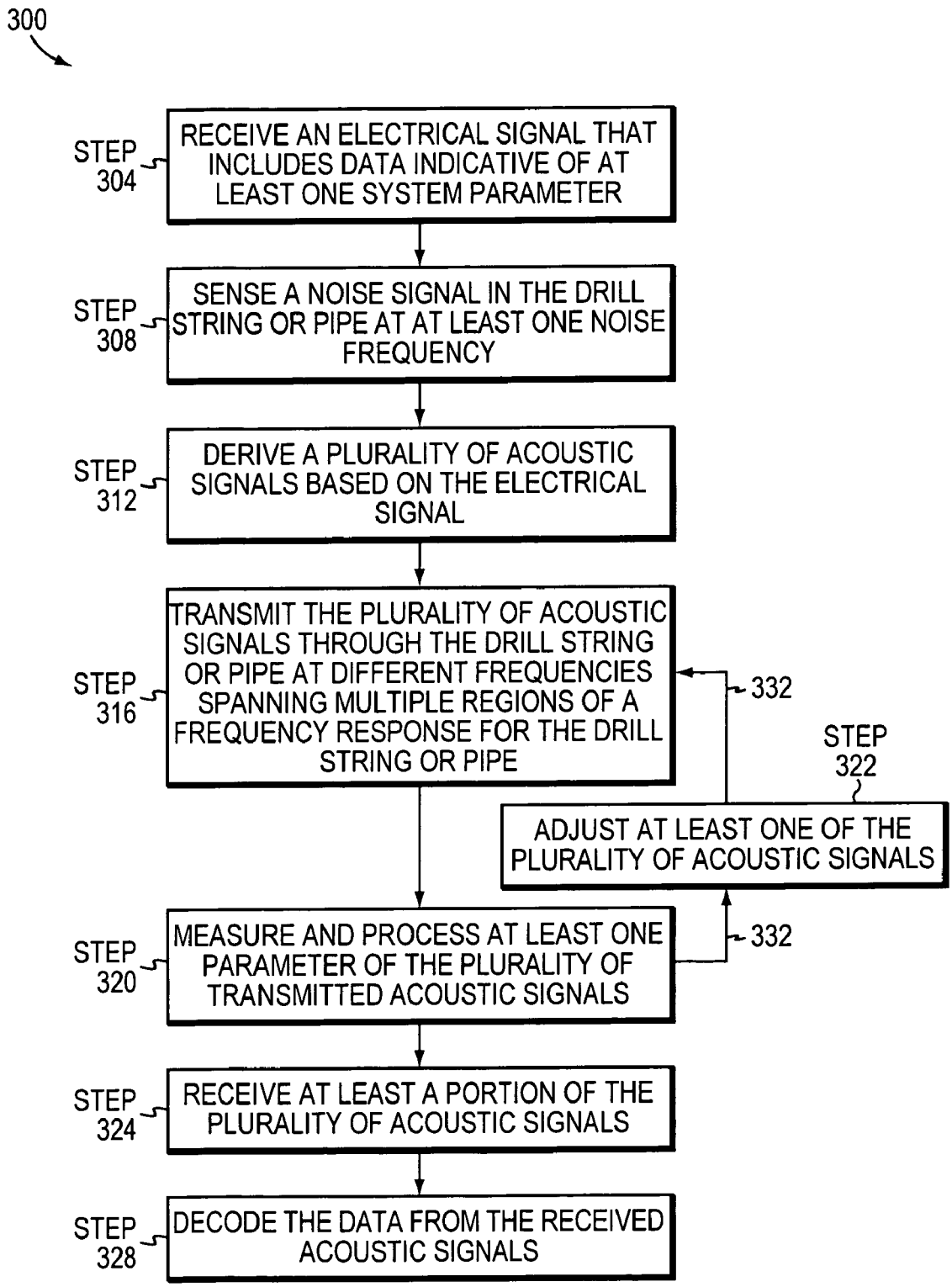
FIG. 7 is a flow diagram of an illustrative embodiment of a method for communicating data through a drill string or pipe in accordance with the invention.

With reference now to FIG. 7, in some embodiments, a method 300 for communicating data through a drill string or pipe, for example using the systems 100, 200 described above with reference to FIGS. 1 and 4-6, includes receiving an electrical signal that includes data indicative of at least one system parameter (step 304), deriving a plurality of acoustic signals based on the electrical signal (step 312), and transmitting the plurality of acoustic signals through the drill string or pipe 112 at different frequencies spanning multiple regions of a frequency response for the drill string (step 316). Optionally, the method may also include one or more of the following steps: sensing a noise signal in the drill string or pipe 112 at at least one noise frequency (step 308), measuring and processing at least one parameter of the plurality of transmitted acoustic signals (step 320), adjusting at least one of the plurality of acoustic signals (step 322), receiving at least a portion of the plurality of acoustic signals (step 324), and decoding the data from the received acoustic signals (step 328).

In greater detail, referring to FIGS. 1 and 4-7, in some embodiments the electrical circuitry 208 receives, at step 304, an electrical signal that includes data indicative of at least one system parameter. The electrical signal may be received from, for example, the sensor 224 and include the data detected, measured, or processed by the sensor. Alternatively, the electrical signal may be received from another source, such as a management module. The management module may generate, for example, an electrical signal that includes data representing the different frequencies at which the plurality of acoustic signals will be transmitted at step 316, or that includes data representing other management information. Such management information may need to be transmitted through the drill string or pipe 112 to the electrical circuitry 236 to facilitate the reception of acoustic signals at step 324 and the proper decoding of data at step 328.

In one embodiment, at step 312, the electrical circuitry 208 and the piezoelectric stack 204 together derive a plurality of acoustic signals based on the electrical signal that has been received by the electrical circuitry 208. The signal processor 212 may, for example, divide the data sequence received in the electrical signal into a plurality of data bits. The electrical circuitry 208 may then drive the piezoelectric stack 204 to generate the plurality of acoustic signals, each one of which represents at least a portion of the data sequence. More specifically, the electrical circuitry 208 may drive the piezoelectric stack so that each data bit is transmitted, at step 316, redundantly (i.e., more than once) through the drill string at different frequencies spanning multiple regions of a frequency response for the drill string. In other words, the transmission that occurs at step 316 may be broadband and redundant, i.e., forward error correction may be incorporated into the broadband signals.

In one non-limiting example intended only to illustrate, and not to restrict, the process undertaken at steps 312 and 316, the signal processor 212 may, after dividing the data sequence received in the electrical signal into a plurality of data bits, group the plurality of data bits into discrete sets of 128 data bits. For each given set of 128 data bits, the electrical circuitry 208 may then drive the piezoelectric stack 204 so that, for each data bit in the set of 128 data bits, four different carrier signals that each have a different carrier frequency are modulated to convey the data bit through the drill string or pipe 112. For example, the electrical circuitry 208 may drive the piezoelectric stack 204 to generate 512 individual carrier signals spaced substantially uniformly between 200 Hz and 1.2 kHz and may modulate each one of the 512 individual carrier signals so that each one of the 128 data bits is redundantly conveyed by 4 different carrier signals through the drill string. Such a process may be repeated by the electrical circuitry 208 for each set of 128 data bits until all the data bits in the data sequence are conveyed through the drill string.

In one particular embodiment, the carrier signals are sinusoidal signals and the data bits are conveyed by modulating the phase of the sinusoidal signals. One skilled in the art will recognize, however, that other types of carrier signals and modulation techniques may be employed. In addition, the number of carrier signals and the amount of redundancy, or forward error correction, employed in communicating the data bits may be varied to suit a particular application.

Transmitting multiple acoustic signals at different frequencies spanning multiple regions of the frequency response for the drill string or pipe 112 guarantees that some energy will be received at the other end of the acoustic propagation channel in virtually all cases, even though the acoustic propagation channel of the drill string may be frequency selective with a response that is both highly variable and not known in advance. Moreover, while the presence of nulls (see FIG. 2) may still result in the loss of 10-40% of the individual signals, particularly over longer spans, transmitting the individual data bits redundantly guarantees that as some of the acoustic signals are lost, the remaining signals will provide enough information to reconstruct the original data sequence.

The plurality of acoustic signals may be imparted, at step 312, to the drill string for transmission therethrough, at step 316, in a variety of ways. For example, referring again to FIG. 4, each piezoelectric element in the uniform piezoelectric stack 204 may have a substantially uniform thickness and be individually driven by the signal processor 212 through the amplifier array 216. Ideally, the piezoelectric elements are driven with signals that have been preprocessed by the signal processor so that their concatenation "sees" a broadband impedance match and so that each one of the resulting acoustic signals propagates through the uniform piezoelectric stack 204 constructively and in phase. Referring again to FIG. 5, each piezoelectric element in the stagger-tuned piezoelectric stack 204 may be of a different thickness and thus tuned to cover a different frequency (i.e., the thicker the element, the lower its resonant frequency), and the number of such piezoelectric elements may be chosen to cover the desired number of different frequencies at which the acoustic signals are to propagate through the drill string or pipe 112. In this embodiment, a plurality of acoustic signals may be imparted to the drill string or pipe 112 by driving each piezoelectric element with the signal processor 212 and through the passive combiner 220 so that the input to the passive combiner 220 "sees" a broadband impedance match.

During a drilling process, substantial acoustic energy may also be introduced into the drill string by the interaction between the drill bit 124 and, for example, a surrounding rock interface. Often, this background noise will have a repeatable harmonic character with, typically, narrowband line components present at a number of repeatable frequencies. Optionally, the downhole accelerometer 228 may therefore be employed, at step 308, to sense a noise signal in the drill string at at least one noise frequency. When sensed, the noise may be readily cancelled at its source through signal processing.

For example, the electrical circuitry 208 may be configured to drive the piezoelectric stack 204 such that each acoustic signal of the plurality of acoustic signals is transmitted, at step 316, at a frequency different from the one or more noise frequencies. In other words, acoustic signals that are each orthogonal to the noise signals present in the drill string or pipe 112 may applied to the pipe's acoustic propagation channel at step 316. When the acoustic signals are processed by a matched receiver at steps 324 and 328, this technique will result in a full cancellation of the drilling noise. An advantage of this technique is that no additional energy is required to cancel the ambient noise; however, the signal processor 212 of the electrical circuitry 208 is required to adapt its creation of the orthogonal acoustic signals to accommodate for major changes in the noise signals.

Alternatively, in another embodiment, an antinoise (i.e., noise-suppressing) system may be employed to cancel the background noise, sensed at step 308, at its source. As explained in greater detail below with reference to FIG. 8, in addition to the plurality of acoustic signals being transmitted through the drill string or pipe 112 at step 316, in an antinoise system the electrical circuitry 208 may drive the piezoelectric stack 204 to excite the drill string or pipe 112 with an additional corrective signal that combines destructively with the ambient noise, thereby counteracting the noise signal.

In still another embodiment, the ambient noise need not be directly sensed by the acoustic telemetry system 200 of the present invention in order to be cancelled. More specifically, rather than directly sensing, at step 308, the noise present in the drill string or pipe 112, the downhole accelerometer 228 may be employed to measure, at step 320, one or more parameters of the plurality of acoustic signals that are transmitted at step 316. In one embodiment, the downhole accelerometer is positioned to measure the one or more parameters at a segment of the drill string that is proximate to an origin for the transmission (e.g., above the drill bit 124 and the piezoelectric stack 204, as illustrated in FIGS. 4 and 5).

The one or more measured parameters may be fed back from the downhole accelerometer 228 to the signal processor 212 of the electrical circuitry 208. The signal processor may then compare the measured parameters with anticipated values therefor. Where a measured parameter differs from its anticipated value, noise will be known to be present in the drill string or pipe 112 and to be interfering with an acoustic signal imparted to the drill string at step 312. Accordingly, as shown by the feedback arrow 332 in FIG. 3, the electrical circuitry 208 may adjust, at step 322, one or more of the plurality of acoustic signals to be transmitted through the drill string or pipe 112 in an effort to counteract the noise present in the drill string or pipe 112. This feedback loop may be employed repetitively to counterbalance the ambient noise.

In one embodiment, at step 324, at least a portion of the plurality of acoustic signals that were transmitted at step 316 are received by the surface accelerometer 232. Some of the acoustic signals may be lost or only faintly received by the surface accelerometer 232 due to the fact that they were transmitted at or near frequencies corresponding to a null in the frequency response plot for the acoustic propagation channel of the drill string (see FIG. 2). However, due to the aforedescribed data redundancy that is built into the acoustic telemetry system 200 of the present invention, it is highly likely that the acoustic signals that are measured by the surface accelerometer 232 contain all of the original data contained within the electrical signal received by the electric circuitry 208 at step 304.

In one embodiment, following the reception of the acoustic signals at step 324, the electrical circuitry 236 decodes, at step 328, the data from the received acoustic signals. In so doing, the electrical circuitry may employ one or more of a variety of decoding techniques. For example, the electrical circuitry may employ a thresholding or hard-limiting technique and select for consideration, in decoding the data, only a subset of the received acoustic signals. In such an embodiment, to be selected for the subset, each acoustic signal may need to have an amplitude greater than a pre-determined value (i.e., each acoustic signal in the subset can not have been affected by the noise present in the drill string by more than a pre-determined amount). As another example, the electrical circuitry may employ a soft decision coding technique. In such an embodiment, the electrical circuitry assigns greater weight in its decoding algorithm to those received acoustic signals having a greater amplitude (i.e., greater weight is given in the decoding algorithm to the received acoustic signals that were the least affected by the noise present in the drill string or pipe 112). In such a fashion, the contribution of the heavily faded acoustic signals is minimized in the overall decoding algorithm.

In decoding the data from the received acoustic signals, the electrical circuitry 236 may identify a discrepancy in the decoded data. In such a case, the electrical circuitry 236 may resolve the discrepancy by a majority rule decoding technique or, alternatively, a maximal ratio combining decoding technique. For example, in an embodiment where the acoustic signals are sine waves with a phase shift of 180° to represent a logic "1" and no phase shift to represent a logic "0," a majority rule decoding technique determines that the bit transmitted was a logic "0" if the majority of the received acoustic signals for the bit have phase shifts between −90° and 90°, and that the bit transmitted was a logic "1" if the majority of the received acoustic signals for the bit have phase shifts between 90° and 270°. Alternatively, a maximal ratio combining technique could be employed to determine the average phase shift of the received acoustic signals for the particular bit in question. In one embodiment, if the average lies between −90° and 90°, the decoding algorithm determines that the bit transmitted was a logic "0." Otherwise, if the average lies between 90° and 270°, the decoding algorithm determines that the bit transmitted was a logic "1."

For example, assuming that, in the above embodiments, acoustic signals for a particular bit having phase shifts of −30°, 30°, and 120° are received, both the majority rule decoding technique and the maximal ratio combining technique will determine that the bit transmitted was a logic "0." More specifically, the majority rule decoding technique will determine that the majority of the received acoustic signals for the bit have phase shifts between −90° and 90°, and the maximal ratio combining technique will determine the average phase shift for the received acoustic signals to be 40°.

One skilled in the art will realize that modifications to the majority rule and maximal ratio combining techniques may be made without departing from the spirit and scope of the invention. For example, in resolving discrepancies, rather than consider all received acoustic signals, the decoding techniques may only consider those received acoustic signals whose phase shifts fall within narrower ranges, such as −45° to 45° and 135° to 225°.

Figure 8:
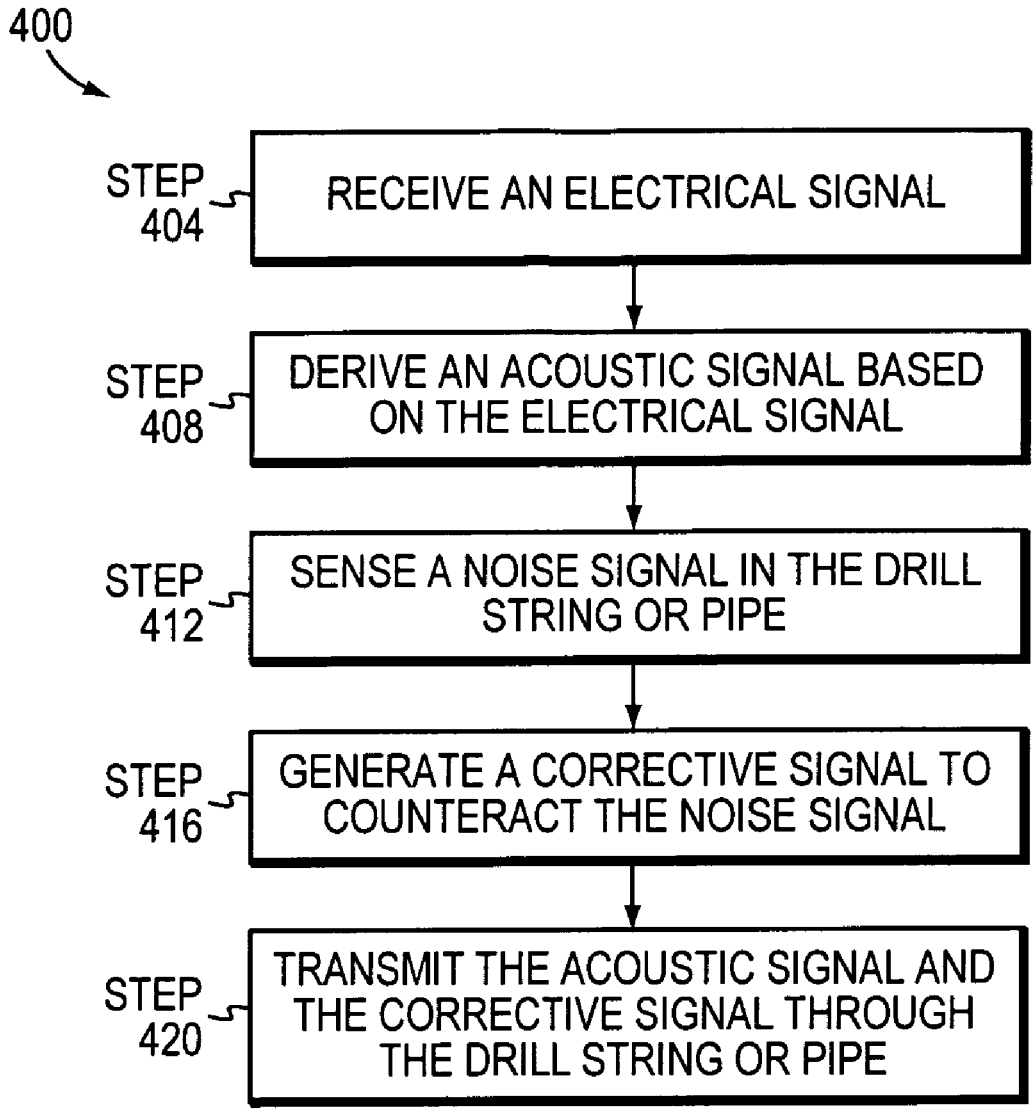
FIG. 8 is a flow diagram of an illustrative embodiment of a method for noise cancellation during data communication through a drill string or pipe in accordance with the invention.

With reference now to FIG. 8, in one embodiment, a method 400 for noise cancellation during data communication through a drill string or pipe, for example using the systems 100, 200 of FIGS. 1 and 4-6, includes receiving an electrical signal (step 404), deriving an acoustic signal based on the electrical signal (step 408), sensing a noise signal in the drill string (step 412), generating a corrective signal to counteract the noise signal (step 416), and transmitting the acoustic and corrective signals through the drill string or pipe 112 (step 420).

More particularly, the electrical signal may be received at step 404 and an acoustic signal based thereon derived at step 408 in a manner similar to that described above for steps 304 and 312 of the method 300, respectively. In addition, as in step 308 for the method 300, the downhole accelerometer 228 may be employed at step 412 to sense a noise signal in the drill string.

Once the noise signal is sensed at step 412, a corrective signal may be generated at step 416 to counteract the noise signal. In one embodiment, the corrective signal is generated by multiplying the noise signal by a factor of −1. In such an embodiment, the corrective signal is simply the mirror opposite of the noise signal. Transmitting that corrective signal through the drill string or pipe 112 at step 420 results in the complete cancellation of the noise signal at its source.

At step 420, the acoustic signal and the corrective signal may each be imparted to the drill string through a common transducer, such as a single piezoelectric stack 204, or, alternatively, they may each be imparted to the drill string through different transducers, such as through two different piezoelectric stacks 204. In either case, the acoustic signal and the corrective signal may each be imparted to the drill string in the same manner as that described above in the method 300, for the plurality of acoustic signals.

Having described certain embodiments of the invention, it will be apparent to those of ordinary skill in the art that other embodiments incorporating the concepts disclosed herein may be used without departing from the spirit and scope of the invention. Accordingly, the described embodiments are to be considered in all respects as only illustrative and not restrictive.

What is claimed is:

1. An acoustic telemetry system, comprising:

a pipe;

a piezoelectric stack at least partially disposed within a segment of the pipe for generating a plurality of acoustic signals containing common information for redundant transmission through the pipe at different frequencies spanning multiple regions of a frequency response for the pipe; and first electrical circuitry for controlling the piezoelectric stack.

2. The system of claim 1 wherein the piezoelectric stack comprises a plurality of piezoelectric elements each having a different thickness.

3. The system of claim 1 wherein the piezoelectric stack comprises a plurality of piezoelectric elements each having a substantially uniform thickness.

4. The system of claim 1, further comprising:

a drill bit located at an operative end of the pipe and proximate to the piezoelectric stack; and a downhole accelerometer, disposed proximate to the drill bit and the piezoelectric stack, for measuring at least one of (i) the plurality of acoustic signals generated for transmission through the pipe and (ii) a noise signal in the pipe.

5. The system of claim 4 wherein the noise signal is present in the pipe at at least one noise frequency and wherein the first electrical circuitry controls the piezoelectric stack to generate the plurality of acoustic signals for transmission through the pipe at frequencies different from the at least one noise frequency.

6. The system of claim 4 wherein the first electrical circuitry controls the piezoelectric stack to generate a corrective signal that counteracts the noise signal.

7. The system of claim 1, further comprising (i) a downhole unit disposed proximate to an operative end of the pipe and (ii) a surface unit, the pipe extending from the downhole unit to the surface unit.

8. The system of claim 7 wherein the surface unit includes a surface accelerometer for measuring at least a portion of the plurality of acoustic signals; and second electrical circuitry for decoding data from the acoustic signals measured at the surface unit.

9. The system of claim 8 wherein the second electrical circuitry selects, in decoding the data, a subset of the acoustic signals measured at the surface unit, each acoustic signal in the subset having an amplitude greater than a pre-determined value.

10. The system of claim 8 wherein the second electrical circuitry identifies a discrepancy in the decoded data and resolves the discrepancy with at least one of a majority rule decoding technique and a maximal ratio combining decoding technique.

11. The system of claim 1, further comprising a sensor, in an electrical communication with the first electrical circuitry, for (i) detecting at least one system parameter and (ii) generating an electrical signal in response thereto, the electrical signal comprising data indicative of the at least one system parameter.

12. The system of claim 11 wherein each one of the plurality of acoustic signals represents at least a portion of the data.

13. The system of claim 11 wherein the sensor measures at least one of the pressure and temperature of a fluid within the pipe.

14. The system of claim 11, further comprising a drill bit located at an operative end of the pipe.

15. The system of claim 14 wherein the sensor measures a resistance encountered by the drill bit.

16. The system of claim 14 wherein the sensor processes image data proximate to the drill bit.

17. An acoustic telemetry system, comprising:

a piezoelectric stack for disposition within a segment of a pipe, the stack, when so disposed, generating a plurality of acoustic signals containing common information for redundant transmission through the pipe at different frequencies spanning multiple regions of a frequency response for the pipe; and first electrical circuitry for controlling the piezoelectric stack.

18. The system of claim 17 wherein the piezoelectric stack comprises a plurality of piezoelectric elements each having a different thickness.

19. The system of claim 17 wherein the piezoelectric stack comprises a plurality of piezoelectric elements each having a substantially uniform thickness.

20. The system of claim 17, further comprising a sensor, in an electrical communication with the first electrical circuitry, for (i) detecting at least one system parameter and (ii) generating an electrical signal in response thereto, the electrical signal comprising data indicative of the at least one system parameter.

21. The system of claim 20 wherein each one of the plurality of acoustic signals represents at least a portion of the data.

* * * * *

UNITED STATES PATENT AND TRADEMARK OFFICE

CERTIFICATE OF CORRECTION

PATENT NO. : 7,590,029 B2
APPLICATION NO. : 11/362629
DATED : September 15, 2009
INVENTOR(S) : Robert D. Tingley It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 709 days.

Signed and Sealed this

Twenty-first Day of September, 2010

David J. Kappos

David J. Kappos
*Director of the United States Patent and Trademark Office*